US006557371B1

(12) United States Patent
Judge

(10) Patent No.: US 6,557,371 B1
(45) Date of Patent: May 6, 2003

(54) APPARATUS AND METHOD FOR DISCHARGING FLUID

(75) Inventor: John F. Judge, Stewartstown, PA (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 09/778,887

(22) Filed: Feb. 8, 2001

(51) Int. Cl.[7] ..... F25B 43/02; F25B 43/00; F28B 1/00

(52) U.S. Cl. ..... 62/468; 62/84; 62/503; 165/110

(58) Field of Search ..... 62/468, 83, 84, 62/503, 509, 512; 165/110, 104.27, 32, 132

(56) References Cited

U.S. PATENT DOCUMENTS

| | | | | |
|---|---|---|---|---|
| 2,121,253 A | * | 6/1938 | McGuffey | 62/513 |
| 3,063,682 A | | 11/1962 | Greene et al. | |
| 3,180,567 A | * | 4/1965 | Quiggle et al. | 62/83 |
| 3,257,824 A | * | 6/1966 | Shikasho | 62/468 |
| 3,370,440 A | * | 2/1968 | Kellie | 62/509 |
| 3,483,714 A | * | 12/1969 | Krause et al. | 62/84 |
| 4,551,990 A | * | 11/1985 | Honoshowsky | 62/468 |
| 4,715,196 A | * | 12/1987 | Sugiura | 62/468 |
| 5,088,294 A | | 2/1992 | Ando | |
| 5,228,315 A | | 7/1993 | Nagasaka et al. | |
| 5,345,785 A | * | 9/1994 | Sekigami et al. | 62/468 |
| 5,396,784 A | | 3/1995 | Huenniger | |
| 5,448,899 A | | 9/1995 | Ohara et al. | |
| 5,505,060 A | * | 4/1996 | Kozinski | 62/503 |

FOREIGN PATENT DOCUMENTS

| | | |
|---|---|---|
| DE | 570 166 | 2/1933 |
| EP | 0 330 198 A2 | 8/1989 |
| GB | 2 161 256 A | 1/1986 |
| GB | 2 231 133 A | 11/1990 |
| JP | 03122473 | 5/1991 |

* cited by examiner

*Primary Examiner*—William C. Doerrler
(74) *Attorney, Agent, or Firm*—Brian T. Sattizahn; Carmen Santa Maria; McNees Wallace & Nurick

(57) ABSTRACT

An apparatus and associated method for discharging a fluid and a liquid separated from the fluid from an outlet chamber of a heat exchanger. The outlet chamber is configured to collect the separated liquid. The outlet chamber is in fluid communication with an outlet opening disposed on an exit surface of the outlet chamber. The apparatus includes a plate that is positionable in the outlet chamber adjacent to the exit surface to form a channel between the plate and the exit surface. The plate is configured to protrude over the outlet tube opening so that the fluid flowing through the outlet chamber and into the outlet opening pulls the liquid collected in the outlet chamber through the channel and out through the outlet opening with the fluid. Because of the plate protruding over the outlet opening, the fluid exiting directly from the outlet chamber through the outlet opening must flow through a decreased area. This decreased area produces the vena contracta effect and creates a low pressure region. The low pressure region draws the collected liquid through the channel and discharges it through the outlet opening with the fluid.

47 Claims, 7 Drawing Sheets

APPARATUS AND METHOD FOR DISCHARGING FLUID

BACKGROUND OF THE INVENTION

The present invention relates generally to apparatus and methods for discharging fluids. More particularly, the present invention relates to an apparatus and associated method for discharging, from an outlet chamber of a heat exchanger, a fluid and a liquid separated from the fluid.

Air-conditioning, refrigeration, or heat-pump systems typically include a compressor, two heat exchangers, and an expansion valve. These components are connected by a series of tubes and pipes to form a circuit through which a fluid flows for cooling or heating a space or a heat transfer fluid. Typically the fluid undergoes a phase change while flowing through the heat exchangers. In one of the heat exchangers conventionally called a condenser, at least a portion of the fluid undergoes a phase change from vapor to liquid, and thereby loses its heat content. In the other heat exchanger conventionally called an evaporator, at least a portion of the fluid undergoes a phase change from liquid to vapor, and thereby increases its heat content. Thus, in an air-conditioning or refrigeration system, a space or a heat transfer fluid to be cooled is coupled with the evaporator. In a heat-pump system, on the other hand, a space or a heat transfer fluid to be heated is coupled with the condenser. Also, a single system may serve as both an air-conditioning or refrigeration system and a heat-pump system by reversing the flow of the fluid.

The fluid in air-conditioning, refrigeration, or heat-pump systems enters the evaporator in the form of a subcooled liquid, a saturated liquid, or a mixture of liquid and vapor. While the fluid flows through the evaporator in small metal tubes, it absorbs heat from a space or a heat transfer fluid and at least part of the liquid portion becomes vapor. Thus, depending on the amount of heat absorbed by the fluid, the fluid exits the evaporator in the form of a mixture of liquid and vapor, a saturated vapor, or a superheated vapor. The fluid then flows through the compressor to increase its pressure. Subsequently, the fluid flows through the condenser where it loses heat to another space or another heat transfer fluid. Depending on the amount of heat lost by the fluid, the fluid exits the condenser in the form of a subcooled liquid, a saturated liquid, or a mixture of liquid and vapor. While the fluid exiting the evaporator or the condenser may assume different forms, at least a portion of the fluid undergoes a phase change due to either heat loss or heat absorption.

Certain air-conditioning, refrigeration, or heat-pump systems are designed such that the fluid exiting the evaporator contains a mixture of liquid and vapor. For example, because the heat transfer characteristic of the fluid is typically poor if more than 90% of the fluid is vapor, an evaporator in a certain air-conditioning or refrigeration system is designed to produce a fluid that contains about 90% vapor portion and 10% liquid portion at its outlet chamber. This evaporator may achieve the maximum heat removal from a space or other heat transfer fluid to be cooled. Part of the liquid portion in the fluid, however, fails to exit the evaporator directly with a bulk flow because it tends to separate from the bulk flow and collects at the bottom portion of the outlet chamber due to gravity. For example, as much as 75% of the liquid portion may separate from the bulk flow and fall to the bottom of the outlet chamber. This separated liquid collecting in the outlet chamber poses at least three problems.

First, the separated liquid may eventually damage the compressor. As the separated liquid continues to build up in the outlet chamber, the liquid level approaches an outlet opening. The liquid then tends to flow out suddenly in a large volume through the outlet opening. This phenomenon is commonly referred to as a liquid "slug." During ongoing operations, the liquid collected in the outlet chamber continues this pattern of build up and sudden "slug" removal rather than a steady and continuous removal. This pattern, referred to as a cyclical purging, may eventually decrease a compressor life. Although compressors may endure a steady and continuous influx of liquid in small amount, they are typically not designed to bear cyclical influxes of large liquid "slugs."

Second, the separated liquid may hinder the flow of the fluid through the evaporator. As the liquid builds up, it blocks some of the metal tubes through which the fluid discharges to the outlet chamber. This blockage impedes a steady flow of the fluid and may decrease the efficiency of the overall air-conditioning, refrigeration, or heat-pump system.

Third, the separated liquid may deprive needed liquids to other components of the air-conditioning, refrigeration, or heat-pump system. For example, in some applications, the fluid includes a small amount of oil to ensure smooth mechanical operation of the compressor. This oil typically falls with the separated liquid to the bottom of the outlet chamber. Without a continuous, steady removal of the separated liquid from the outlet chamber, the oil needed for a proper mechanical operation may not reach the compressor.

Therefore, there exists a need for an apparatus and method for continuously and steadily discharging a liquid, which is separated from the bulk flow of a fluid and collected in an outlet chamber.

SUMMARY OF THE INVENTION

Accordingly, the present invention is directed to an apparatus and associated method for discharging, from an outlet chamber of a heat exchanger, a fluid and a liquid separated from the fluid that obviate one or more of the limitations and disadvantages of prior art apparatus and methods. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to an apparatus for discharging from an outlet chamber a fluid and a liquid separated from the fluid. The outlet chamber is configured to collect the separated liquid. The outlet chamber is in fluid communication with an outlet opening disposed on an exit surface of the outlet chamber. The apparatus includes a plate positionable in the outlet chamber adjacent to the exit surface to form a channel between the plate and the exit surface. The plate is configured to protrude over the outlet opening so that the fluid flowing through the outlet chamber and into the outlet opening pulls the liquid collected in the outlet chamber through the channel and out through the outlet opening with the fluid.

In another aspect, the invention is directed to a method for discharging from an outlet chamber a fluid and a liquid separated from the fluid. The outlet chamber is configured to collect separated liquid. The outlet chamber is in fluid communication with an outlet opening disposed on an exit surface of the outlet chamber. The method steps includes: positioning a plate in the outlet chamber adjacent to the exit surface so that the plate and the exit surface form a channel therebetween and the plate protrudes over the outlet opening; and flowing the fluid through the outlet chamber and into the outlet opening to pull the liquid collected in the outlet chamber through the channel and out through the outlet opening with the fluid.

In yet another aspect, the invention is directed to a heat exchanger. The heat exchanger includes a main chamber, an outlet chamber, an outlet opening, and a plate. A fluid flows through the main chamber to absorb heat. The outlet chamber is configured to receive the fluid from the main chamber and to collect a liquid separated from the fluid. The outlet opening is disposed on an exit surface of the outlet chamber and is in fluid communication with the outlet chamber. The plate is positioned in the outlet chamber adjacent to the exit surface to form a channel between the plate and the exit surface. The plate protrudes over the outlet opening so that the fluid flowing through the outlet chamber and into the outlet opening pulls the liquid collected in the outlet chamber through the channel and out through the outlet opening with the fluid.

In yet another aspect, the invention is directed to a heat exchanging system having a fluid flowing therethrough in a cycle. The heat exchanging system includes a compressor, a first heat exchanger, an expansion device, and a second heat exchanger. The first heat exchanger receives the fluid from the compressor and discharges the fluid after the fluid loses heat while flowing through the first heat exchanger. The expansion device receives the fluid from the first heat exchanger. The second heat exchanger receives the fluid from the expansion device and discharges the fluid to the compressor. The second heat exchanger includes a main chamber, an outlet chamber, an outlet opening, and a plate. The fluid flows through the main chamber to absorb heat. The outlet chamber is configured to receive the fluid from the main chamber and to collect a liquid separated from the fluid. The outlet opening is disposed on an exit surface of the outlet chamber and is in fluid communication with the outlet chamber. The plate is positioned in the outlet chamber adjacent to the exit surface to form a channel between the plate and the exit surface. The plate protrudes over the outlet opening so that the fluid flowing through the outlet chamber and into the outlet opening pulls the liquid collected in the outlet chamber through the channel and out through the outlet opening with the fluid.

It is to be understood that both the foregoing general description and the following detailed description are exemplary and explanatory only and are not restrictive of the invention, as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DETAILED DESCRIPTION

Reference will now be made in detail to the presently preferred embodiment of the present invention, an example of which is illustrated in the accompanying drawings. Wherever possible, the same reference numbers will be used throughout the drawings to refer to the same or like parts.

Figure 1:
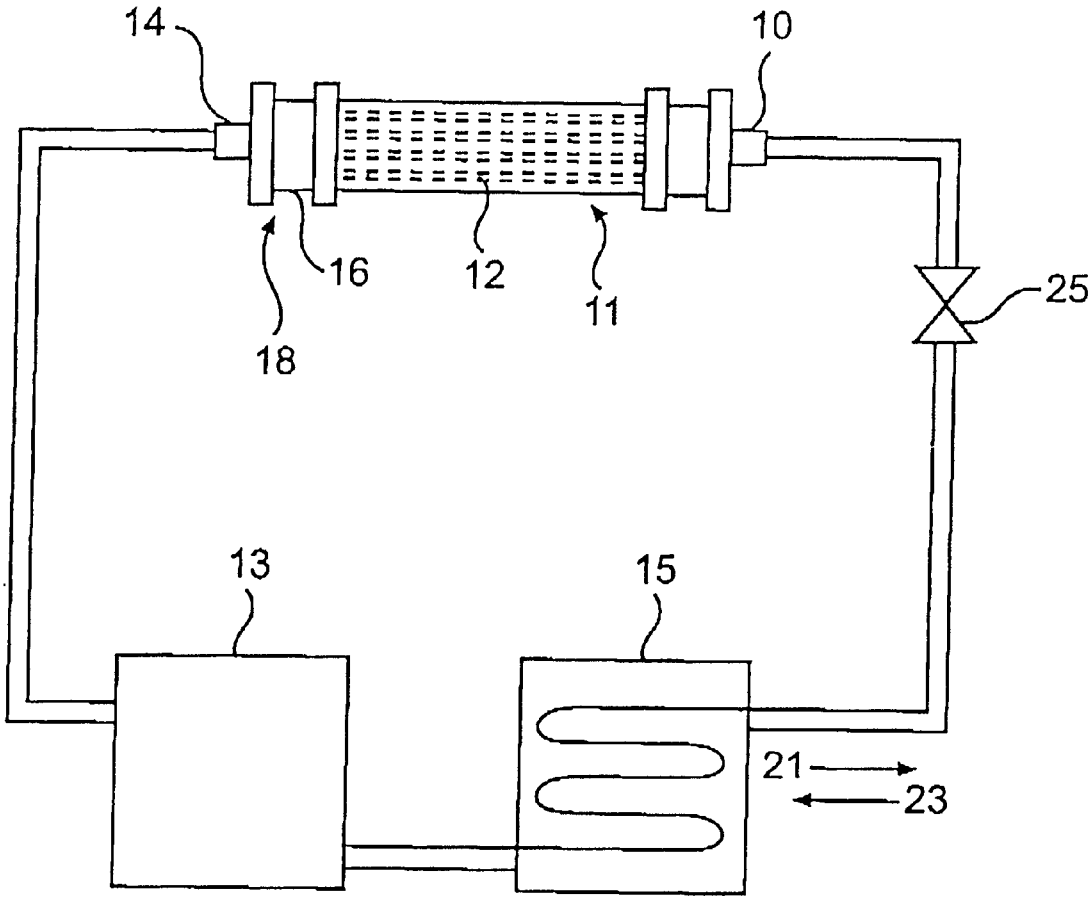
FIG. 1 is a schematic diagram of an air-conditioning, refrigeration, or heat-pump system in accordance with the present invention.

In accordance with the present invention and illustrated in FIG. 1, an air-conditioning, refrigeration, or heat-pump system includes two heat exchangers 11 and 15, a compressor 13, and an expansion valve 25. Tubes or pipes connect heat exchangers 11 and 15, compressor 13, and expansion valve 25. A fluid at a given pressure flows through heat exchanger 15, conventionally called a condenser. While flowing through condenser 15, the fluid loses heat. The fluid then flows through expansion valve 25 where its pressure decreases to another level. The fluid then flows through heat exchanger 11, conventionally called an evaporator. While flowing though evaporator 11, the fluid absorbs heat. Finally, the fluid flows through compressor 13 where its pressure increases back to the original level. Thus, the fluid flowing through the system form an air-conditioning, refrigeration, or heat-pump cycle. Heat exchangers 11 and 15 are respectively called an evaporator and a condenser because at least a portion of the fluid undergoes a phase change while flowing though them. At least a portion of the fluid changes from liquid to vapor in evaporator 11 while at least a portion of the fluid changes from vapor to liquid in condenser 15.

Because the fluid flowing through evaporator 11 absorbs heat, an air-conditioning or refrigeration system results if evaporator 11 is placed in a space to be cooled. On the other hand, because the fluid flowing through condenser 15 loses heat, a heat-pump system results if condenser 15 is placed in a space to be heated. Evaporator 11 and condenser 15 may directly cool or heat a space (e.g., through air inside). Alternatively, evaporator 11 and condenser 15 may exchange heat with other heat transfer fluids (e.g., water) which in turn will either cool or heat a space through another heat transfer mechanism.

Furthermore, a system that exchanges heat directly with outside air can serve as both an air-conditioning or refrigeration system and a heat-pump system. For example, during the summer, the system shown in FIG. 1 may serve as an air-conditioning or refrigeration system where evaporator 11 cools inside air by absorbing heat while condenser 15 loses heat to outside air. In this air-conditioning or refrigeration system, the fluid flows in a direction indicated by reference number 21. During the winter, on the other hand, expansion valve 25 may actuate to reverse the flow of the fluid in the other direction indicated by reference number 23 to transform the air-conditioning or refrigeration system into a heat-pump system. In this heat-pump system, heat exchanger 11 becomes a condenser, which warms the inside air by losing heat, while heat exchanger 15 becomes an evaporator, which absorbs heat from the outside air.

For purposes of illustrating the preferred embodiment of the present invention, the detailed descriptions below are directed to an exemplary refrigeration system having a direct expansion evaporator absorbing heat from a heat transfer fluid. However, the present invention is by no means limited to a particular system or heat exchanger. Rather, the present invention encompasses any device and method for discharging a liquid separated from a bulk flow continuously and steadily with the bulk flow.

Figure 2:
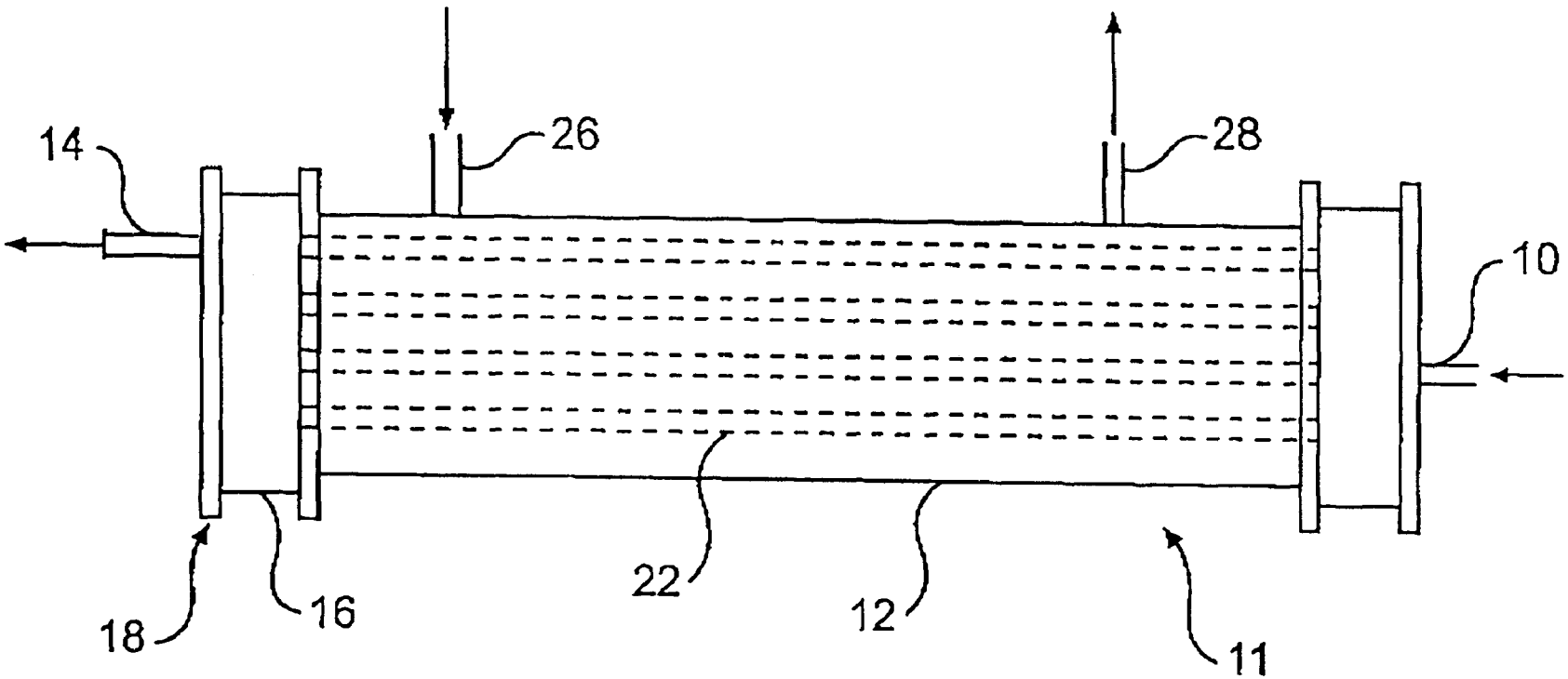
FIG. 2 is a side view of a direct expansion evaporator in accordance with the present invention.

FIG. 2 shows a direct expansion evaporator 11 in a refrigeration system. Direct expansion evaporator 11 includes a refrigerant inlet 10, a main chamber 12, and a refrigerant outlet 14. Direct expansion evaporator 11 also includes an outlet chamber 16 located at its last pass 18. A refrigerant enters direct expansion evaporator 11, flows through evaporator tubes 22, arranged in a bundle within main chamber 12, and flows into outlet chamber 16 before exiting through refrigerant outlet 14. At the same time, a heat transfer fluid (e.g., water) enters main chamber 12 through a heat transfer fluid inlet 26, flows across the outside surfaces of evaporator tubes 22, and then exits the main chamber 12 through a heat transfer fluid outlet 28. While the refrigerant and the heat transfer fluid flow through direct expansion evaporator 11, the refrigerant absorbs heat from the heat transfer fluid. Consequently, the heat transfer fluid loses its heat content (e.g., the temperature of the heat transfer fluid decreases). The heat transfer fluid may then cool a space or other things through another heat transfer mechanism.

As a result of absorbing heat from the heat transfer fluid, at least a portion of the refrigerant undergoes a phase change from liquid to vapor. Thus, the refrigerant entering outlet chamber 16 typically becomes a mixture of liquid and vapor. However, depending on the particular design of direct expansion evaporator 11 and the heat content of the heat transfer fluid, all the refrigerant entering outlet chamber 16 may become vapor. In other words, all the refrigerant entering outlet chamber 16 may become saturated vapor or superheated vapor. Furthermore, the refrigerant may contain oil (e.g., lubrication oil) to ensure smooth mechanical operation of compressor (FIG. 1). Unlike the refrigerant, the oil in a liquid form does not undergo a phase change. Accordingly, the fluid entering outlet chamber 16 may contain (1) a mixture of refrigerant vapor and liquid without oil, (2) refrigerant vapor without oil, (3) a mixture of refrigerant vapor and liquid with oil, or (4) refrigerant vapor with oil.

Figure 5:
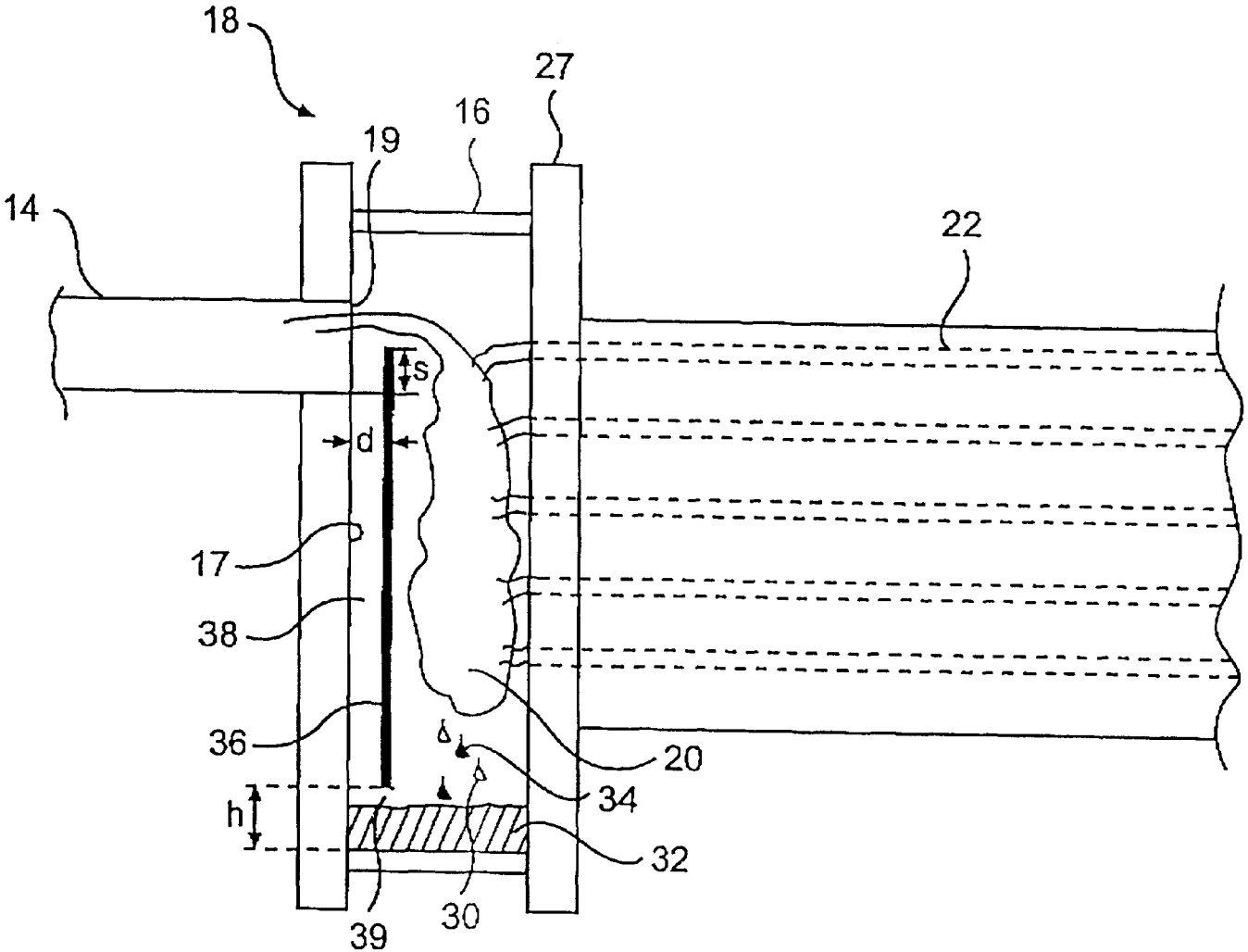
FIG. 5 is a side, sectional view of a direct expansion evaporator in accordance with the present invention illustrating a bulk fluid flow and a liquid collected at the bottom portion of an outlet chamber after separating from the bulk fluid flow.

As illustrated in FIG. 5, the bulk of the fluid entering outlet chamber 16 directly exits outlet chamber 16 through an outlet opening 19. Reference number 20 designates this bulk flow of the fluid. However, part of the liquid portion in the fluid tends to separate from bulk flow 20 and falls to the bottom of outlet chamber 16 due to gravity. The separated liquid collected at the bottom portion of outlet chamber 16 may be liquid refrigerant 30, oil 34, or a mixture thereof. Even if the refrigerant entering outlet chamber 16 is all vapor, liquid refrigerant may form due to the vapor losing heat. in outlet chamber 16. This newly-formed liquid refrigerant may separate from bulk flow 20 and fall to the bottom portion of outlet chamber 16 as well.

To continuously and steadily discharge the collected liquid with bulk flow 20, outlet chamber 16 includes a plate 36. Plate 36 cooperates with adjacent surfaces of outlet chamber 16 and the flow characteristics within outlet chamber 16 to continuously and steadily discharge the collected liquid with bulk flow 20. As illustrated in FIG. 5, plate 36 is positioned within outlet chamber 16 adjacent to an exit surface 17 of outlet chamber 16. Exit surface 17 and plate 36 are separated by distance d and form a channel 38 therebetween. The bottom of plate 36 is spaced from the bottom of outlet chamber 16 by distance h so that the collected liquid 32 can enter channel 38 through a flow path 39. Plate 36 protrudes over outlet opening 19 by distance s to create a low pressure region to draw up collected liquid 32 though channel 38.

Figure 6:
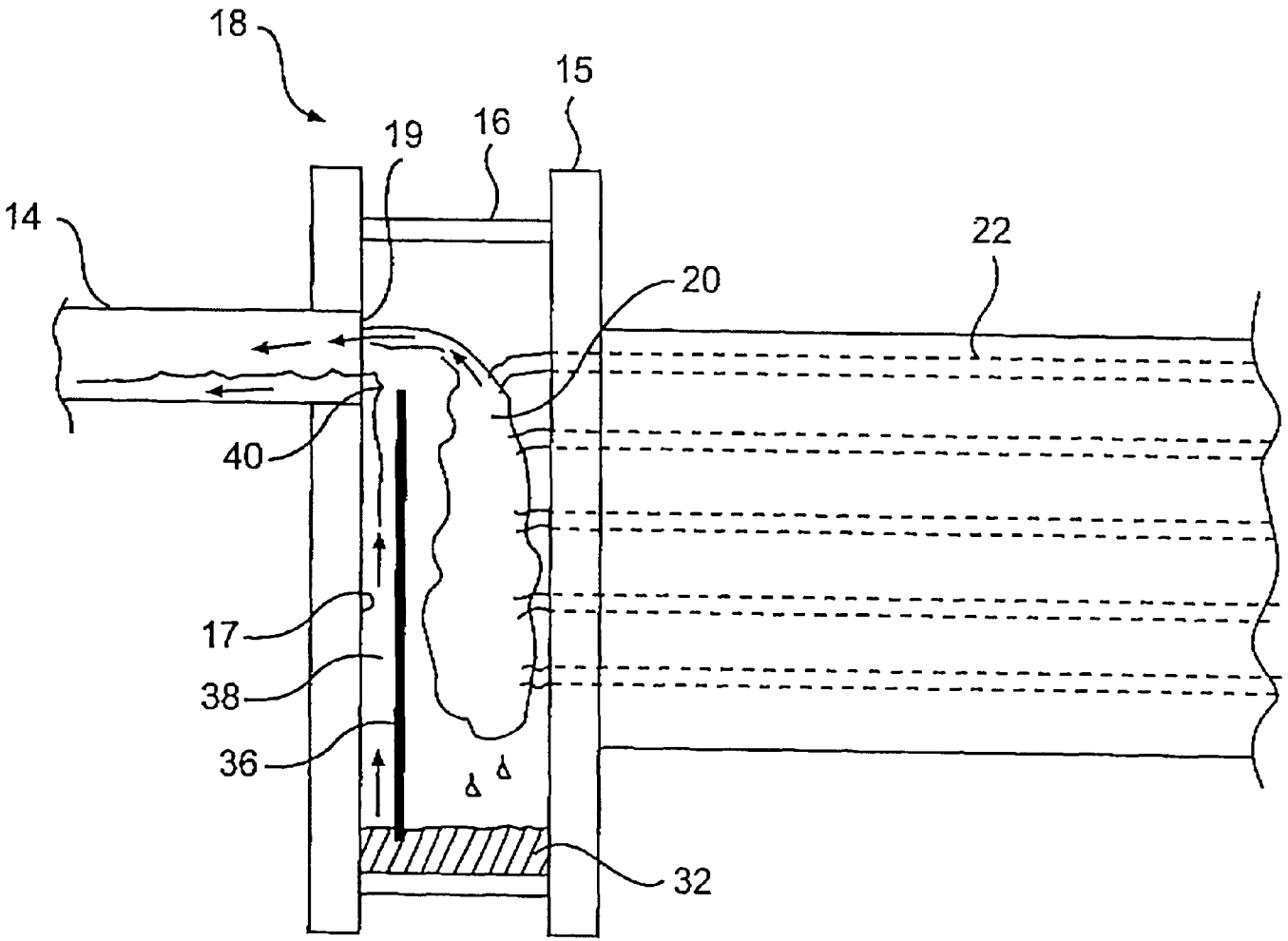
FIG. 6 is a side, sectional view of a direct expansion evaporator in accordance with the present invention illustrating a liquid collected at the bottom portion of an outlet chamber exiting a direct expansion evaporator with a bulk fluid flow.

As illustrated in FIG. 6, plate 36 protrudes over outlet opening 19 by distance s (FIG. 5) so that bulk flow 20 flowing into outlet opening 19 must pass through a reduced area. Because of the reduced area, the vena contracta effect increases the velocity of bulk flow 20 and, at the same time, decreases the pressure of bulk flow 20 in a region 40. Thus, plate 36 protruding over outlet opening 19 and bulk flow 20 create a lower-pressure region 40. In addition to the vena contracta effect, bulk flow 20 induces a pressure drop due to friction loss. This pressure drop due to friction loss also contributes to the creation of low pressure region 40.

This low pressure region 40 draws up collected liquid 32 though channel 38 between plate 36 and exit surface 17 when the level of collected liquid 32 rises above h (FIG. 5). Then, as shown in FIG. 6, collected liquid 32 exits direct expansion evaporator 11 with bulk flow 20 through outlet opening 19. Low pressure region 40 may flash a portion of liquid refrigerant 30 (FIG. 5) into vapor as collected liquid 32 is drawn up through channel 38. No oil 34, however, becomes vapor as collected liquid 32 is drawn up through channel 38. The flashing of liquid refrigerant 30 is believed to be minimal, if any, because the pressure differential between low pressure region 40 and collected liquid 32 is small.

Preferably, the distances d, h, and s shown in FIG. 5 are determined through empirical testing. The distances d, h, and s vary depending on many factors, including, among other things, the operating conditions of the evaporator, the size of outlet opening 19, the size of outlet chamber 16, the desired flow characteristics of collected liquid 32 through channel 38, the capacity of the refrigeration system, the operating pressure of direct expansion evaporator 11. The distances d, h and s may be determined, or at least approximated, analytically given the desired flow characteristics of collected liquid 32 through channel 38, relevant dimensions of direct expansion evaporator 11, and flow characteristics of bulk flow 20. However, a precise analytical determination may be extremely difficult because not all flow characteristics are readily known. Given these circumstances, empirical determinations, with or without some initial approximation through analytical determination, are preferred to determine the distances d, h, and s.

The following dimensions and placements are provided to further illustrate one preferred embodiment in accordance with the present invention. These dimensions and placements correspond to an application in which 150 tons of refrigeration are desired. However, it should be recognized that these dimensions and placements are exemplary in nature and do not limit the scope of the present invention.

Figure 3:
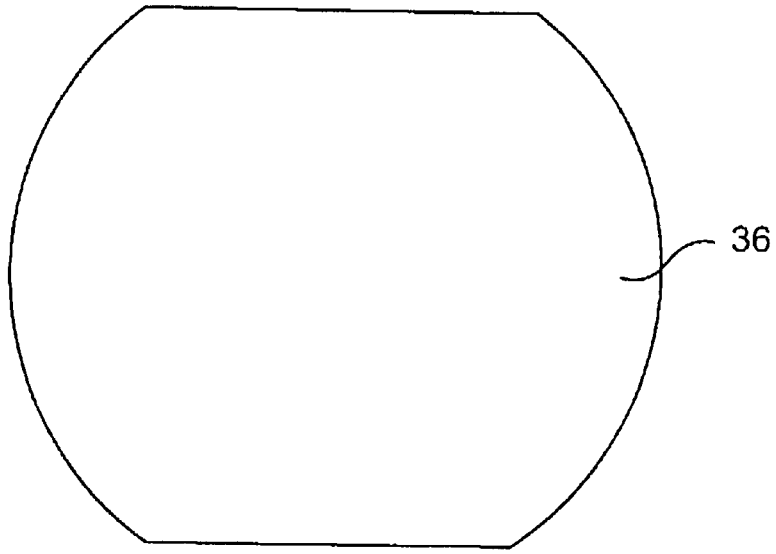
FIG. 3 is a front view of a plate in accordance with the present invention.
Figure 4:
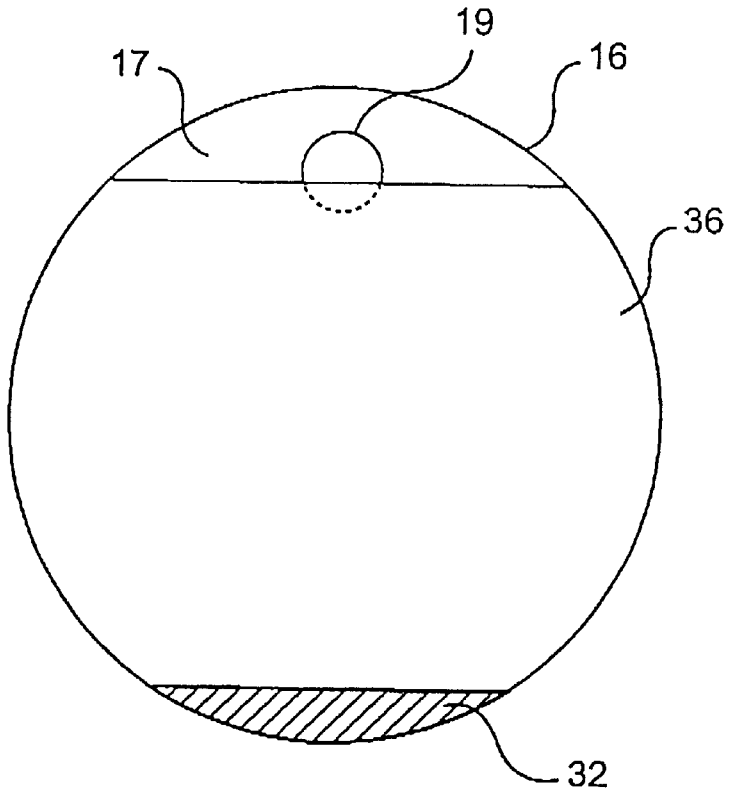
FIG. 4 is a front view of a plate and an outlet chamber of a direct expansion evaporator in accordance with the present invention.

In an application in which 150 tons of refrigeration are desired, plate 36 is preferably fabricated from a ⅛" thick circular piece of carbon steel (e.g., ASTM A-36) having a diameter of 20". As shown in FIGS. 3 and 4, the top and bottom portions of plate 36 are removed. Outlet chamber 16 is cylindrical in shape and preferably has a 20" inside diameter, a length of 1⅜" and a wall thickness of ½". The diameters of plate 36 and outlet chamber 16 are the same so that plate 36 stretches all the way to the sides of outlet chamber 16 as shown in FIG. 4. Plate 36 is joined with the side surfaces of outlet chamber 16 by welding, press-fitting, or other known techniques to provide channel 38 between plate 36 and exit surface 17 from the bottom of plate 36 to the top thereof. Channel 38 does not have to provide a fluid-tight seal for the purpose of the present invention.

Refrigerant outlet 14 has an outside diameter of 2½" and a thickness of 1/16". It is located 2½" from the top of outlet chamber 16, measured from the inside of the top of outlet chamber 16 to the inside of the top of refrigerant outlet 14. Plate 36 is placed ¼" (the distance d in FIG. 5) from exit surface 17 and protrudes ½" (the distance s in FIG. 5) above the inside of the bottom of refrigerant outlet 14. The bottom of plate 36 is placed ¼" to ½" (the distance h in FIG. 5) from the bottom of outlet chamber 16. The tube head 27 is ¾" thick and has ⅝" holes to support multiple ⅝" evaporator tubes 22.

Again, all of these dimensions and placements are used in an application in which 150 tons of refrigeration are desired. The present invention, however, encompasses more than just the preferred embodiment described above. Any variations that produce a steady and continuous removal of a liquid separated from a bulk fluid flow is encompassed by the present invention regardless of the desired total refrigerant output.

Figure 7:
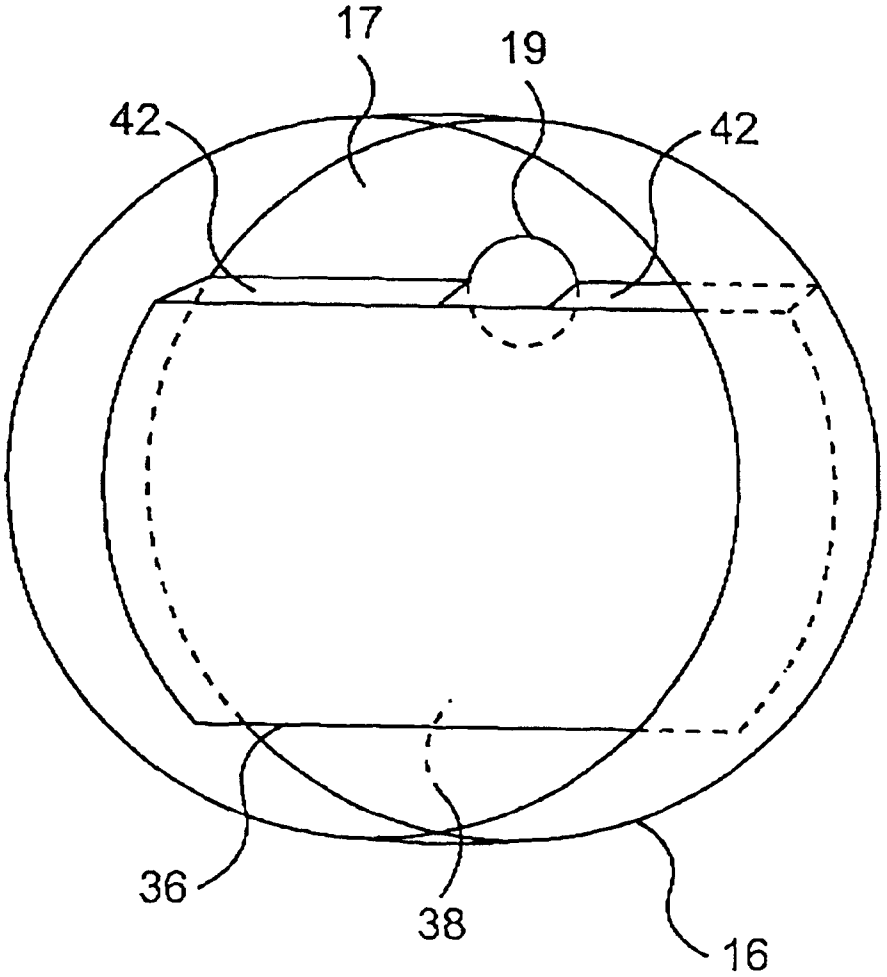
FIG. 7 is a perspective view of an outlet chamber of a direct expansion evaporator and a plate having horizontal walls in accordance with the present invention.

Although FIGS. 3 and 4 show the top and bottom of plate 36 as straight, they may assume different forms. For example, the top and bottom of plate 36 may be curved rather than straight. Also, a pair of horizontal walls 42, separated by a predetermined distance, may be provided at the top of plate 36 around outlet opening 19 as shown in FIG. 7. These horizontal walls 42 extend from the top of plate 36 to exit surface 17 where they are joined with exit surface 17 by welding, press-fitting, or other known techniques. These horizontal walls 42 improve the flow efficiency of the collected liquid by preventing it from taking a tortuous path before entering outlet opening 19. For example, without horizontal walls 42, the collected liquid may flow to the top of exit surface 17 and around outlet opening 19 many times before finally entering outlet opening 19. Horizontal walls 42 eliminate this flow inefficiency.

Figure 8:
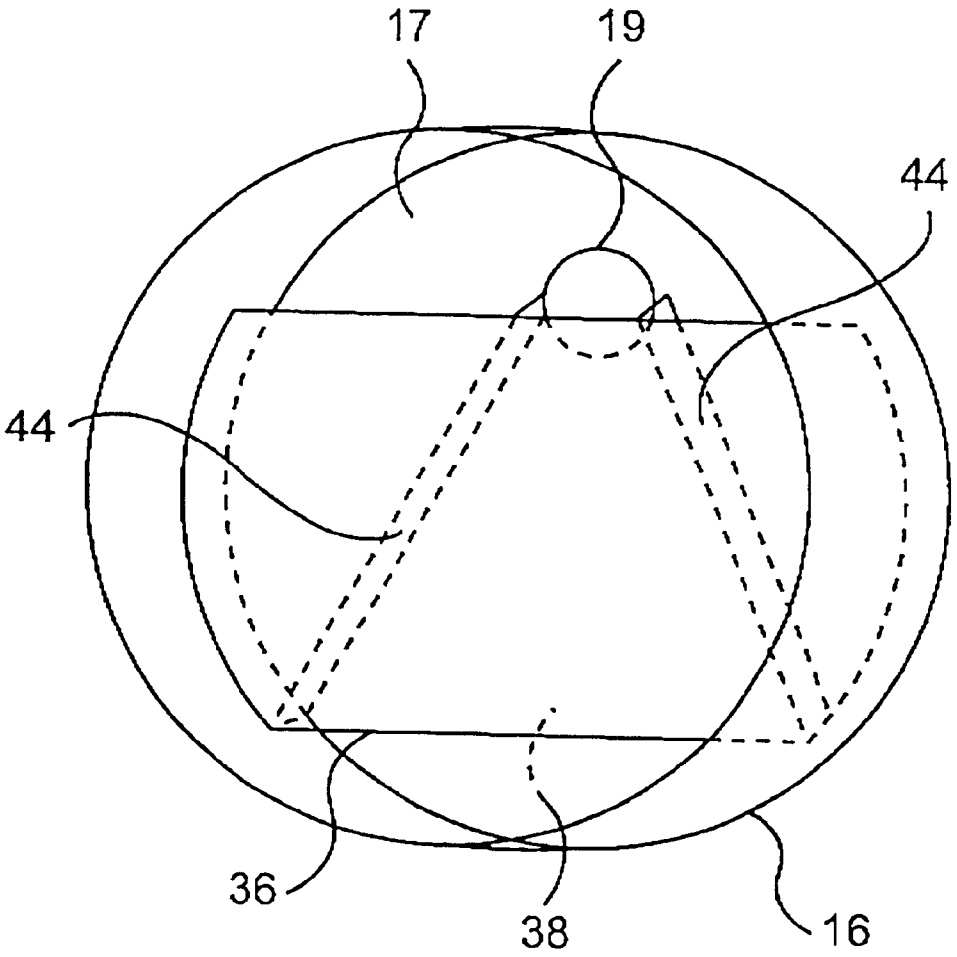
FIG. 8 is a perspective view of an outlet chamber of a direct expansion evaporator and a plate having diagonal walls in accordance with the present invention.

Alternatively, a pair of diagonal walls 44 may be provided within plate 36 as shown in FIG. 8. These diagonal walls 44 extend from the bottom of plate 36 to the top thereof. These diagonal walls 44 also extend from a surface of plate 36 toward exit surface 17 where they are joined with exit surface 17 by welding, press-fitting, or other known techniques. Thus, instead of the side surfaces of outlet chamber 16, these diagonal walls 44 form channel 38 in conjunction with plate 36 and exit surface 17. These diagonal walls 44 also improve the flow efficiency of the collected liquid by guiding it directly to outlet opening 19. Thus, diagonal walls 44 prevent the collected liquid from taking a tortuous path before entering outlet opening 19. Of course, plate 36 may be provided with horizontal walls 42 as well as diagonal walls 44.

The operation of the aforementioned plate and direct expansion evaporator will now be described with reference to the attached drawings. It should be recognized, however, that the present invention encompasses more than a direct expansion evaporator in a refrigeration system. Although a direct expansion evaporator in a refrigeration system is described in order to illustrate the principles of the present invention, the present invention encompasses any device and method for discharging a liquid separated from a bulk flow continuously and steadily with the bulk flow.

As shown in FIG. 2, a refrigerant flows through evaporator tubes 22 and absorbs heat from a heat transfer fluid. The absorbed heat converts at least a portion of the refrigerant from liquid to vapor. As a result, the refrigerant entering outlet chamber 16 becomes either a mixture of liquid and vapor or all vapor. Unlike the refrigerant, oil, which may be added to the refrigerant for lubrication, remains in a liquid form. Thus, the outlet chamber 16 may receive (1) a mixture of refrigerant liquid and vapor without oil, (2) refrigerant vapor without oil, (3) a mixture of refrigerant liquid and vapor with oil, or (4) refrigerant vapor with oil.

As shown in FIG. 5, the bulk of the fluid enters outlet chamber 16 and directly exits through outlet opening 19. Part of the liquid portion, however, separates from bulk flow 20 and falls to the bottom portion of outlet chamber 16. This liquid portion, which separates from bulk flow 20 and collects at the bottom portion of outlet chamber 16, may be liquid refrigerant 30, oil 34, or a mixture thereof. Even if the refrigerant entering outlet chamber 16 is all vapor without oil, part of the vapor may become liquid by losing heat (e.g., heat loss to outside environment) in outlet chamber 16. Part of this liquid may separate from bulk flow 20 and collect at the bottom portion of outlet chamber 16.

As shown in FIG. 6, collected liquid 32 is discharged continuously and steadily through outlet opening 19 with bulk flow 20 when its level rises above the bottom of plate 36. Because plate 36 protrudes over outlet opening 19, bulk flow 20 must pass through a decreased area before exiting through outlet opening 19. This decreased area produces the vena contracta effect, which leads to low pressure region 40. Low pressure region 40 draws up collected liquid 32 through channel 38 and discharges it through outlet opening 19 with bulk flow 20. Therefore, plate 36 removes collected liquid 32 continuously and steadily from outlet chamber 16, and thus avoids a sudden "slug" removal.

The present invention includes apparatus and related methods for discharging a fluid and a liquid separated from the fluid and collected at the bottom portion of an outlet chamber. A bulk of the fluid directly exits the outlet chamber through an outlet opening disposed on an exit surface of the outlet chamber. Part of the liquid portion of the fluid, however, falls to and collects at the bottom portion of the outlet chamber due to gravity and fails to exit directly. To discharge the collected liquid from the outlet chamber with the bulk flow of the fluid, a plate is positioned adjacent to the exit surface to form a channel therebetween. The plate protrudes over the outlet opening so that the bulk fluid flowing into the outlet opening must pass through a decreased area and thereby creates a low pressure region at the top of the channel. This low pressure region draws up the collected liquid through the channel and discharge it through the outlet opening with the bulk flow. Consequently, the collected liquid is discharged continuously and steadily without a sudden "slug" discharge. Preferably, the present invention is used in a direct expansion evaporator of a refrigeration system. The present invention, however, may be used in any device to discharge a liquid separated from a bulk fluid continuously and steadily with the bulk fluid.

It will be apparent to those skilled in the art that various modifications and variations can be made to the structure and method of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for discharging from an outlet chamber a fluid and a liquid separated from the fluid, the outlet chamber configured to collect the separated liquid, the outlet chamber in fluid communication with an outlet opening disposed on an exit surface of the outlet chamber, comprising:

a plate positionable in the outlet chamber adjacent to the exit surface to form a channel between the plate and the exit surface, the plate configured to protrude over the outlet opening so that the fluid flowing through the outlet chamber and into the outlet opening pulls the liquid collected in the outlet chamber through the channel and out through the outlet opening with the fluid.

2. The apparatus of claim 1, wherein the plate is configured to form a flow path between the bottom of the outlet chamber and the bottom of the plate for the collected liquid to flow to the channel.

3. The apparatus of claim 1, wherein the plate is configured to be joined with side surfaces of the outlet chamber to form the channel between the plate and the exit surface.

4. The apparatus of claim 1, wherein the plate further comprises walls extending from the top thereof and configured to be joined with the exit surface.

5. The apparatus of claim 1, wherein the plate further comprises walls extending from the bottom to the top thereof and configured to be joined with the exit surface to form the channel.

6. The apparatus of claim 1, wherein the plate is a disk having top and bottom portions thereof removed.

7. The apparatus of claim 1, wherein the plate is configured to protrude less than an inch over the outlet opening.

8. The apparatus of claim 1, wherein the plate is configured to be positioned less than an inch from the exit surface.

9. The apparatus of claim 1, wherein the bottom of the plate is configured to be positioned less than an inch from the bottom of the outlet chamber.

10. A method for discharging from an outlet chamber a fluid and a liquid separated from the fluid, the outlet chamber configured to collect the separated liquid, the outlet chamber in fluid communication with an outlet opening disposed on an exit surface of the outlet chamber, comprising the steps of:

positioning a plate in the outlet chamber adjacent to the exit surface so that the plate and the exit surface form a channel therebetween and the plate protrudes over the outlet opening; and flowing the fluid through the outlet chamber and into the outlet opening to pull the liquid collected in the outlet chamber through the channel and out through the outlet opening with the fluid.

11. The method of claim 10, further comprising the step of spacing the bottom of the plate from the bottom of the outlet chamber to form a flow path for the collected liquid to flow to the channel.

12. The method of claim 10, further comprising the step of joining the plate with side surfaces of the outlet chamber to form the channel between the plate and the exit surface.

13. The method of claim 10, further comprising the step of joining walls extending from the top of the plate with the exit surface.

14. The method of claim 10, further comprising the step of joining walls extending from the bottom of the plate to the top of the plate with the exit surface to form the channel.

15. The method of claim 10, wherein the plate protrudes less than an inch over the outlet opening.

16. The method of claim 10, wherein the plate is positioned less than an inch from the exit surface.

17. The method of claim 10, wherein the bottom of the plate is positioned less than an inch from the bottom of the outlet chamber.

18. A heat exchanger, comprising:

a main chamber having a fluid flowing therethrough to absorb heat;

an outlet chamber configured to receive the fluid from the main chamber and to collect a liquid separated from the fluid;

an outlet opening disposed on an exit surface of the outlet chamber, the outlet opening in fluid communication with the outlet chamber; and a plate positioned in the outlet chamber adjacent to the exit surface to form a channel between the plate and the exit surface, the plate protruding over the outlet opening so that the fluid flowing through the outlet chamber and into the outlet opening pulls the liquid collected in the outlet chamber through the channel and out through the outlet opening with the fluid.

19. The heat exchanger of claim 18, wherein the bottom of the plate is spaced from the bottom of the outlet chamber to form a flow path for the collected liquid to flow to the channel.

20. The heat exchanger of claim 18, wherein the plate is joined with side surfaces of the outlet chamber to form the channel between the plate and the exit surface.

21. The heat exchanger of claim 18, wherein the plate further comprises walls extending from the top thereof and joined with the exit surface.

22. The heat exchanger of claim 18, wherein the plate further comprises walls extending from the bottom to the top thereof and joined with the exit surface to form the channel.

23. The heat exchanger of claim 18, wherein at least a portion of the fluid undergoes a phase change from liquid to vapor while flowing through the main chamber.

24. The heat exchanger of claim 23, wherein the fluid includes a refrigerant.

25. The heat exchanger of claim 24, wherein the liquid collected in the outlet chamber includes the refrigerant.

26. The heat exchanger of claim 24, wherein the fluid includes an oil.

27. The heat exchanger of claim 26, wherein the liquid collected in the outlet chamber includes the oil.

28. The heat exchanger of claim 27, wherein the liquid collected in the outlet chamber includes the refrigerant.

29. The heat exchanger of claim 18, wherein the plate is a disk having top and bottom portions thereof removed.

30. The heat exchanger of claim 18, wherein the plate protrudes less than an inch over the outlet opening.

31. The heat exchanger of claim 18, wherein the plate is positioned less than an inch from the exit surface.

32. The heat exchanger of claim 18, wherein the bottom of the plate is positioned less than an inch from the bottom of the outlet chamber.

33. A heat exchanging system having a fluid flowing therethrough in a cycle, comprising:

a compressor;

a first heat exchanger receiving the fluid from the compressor and discharging the fluid after the fluid loses heat while flowing through the first heat exchanger;

an expansion device receiving the fluid from the first heat exchanger; and a second heat exchanger receiving the fluid from the expansion device and discharging the fluid to the compressor, the second heat exchanger comprising:

a main chamber having the fluid flowing therethrough to absorb heat;

an outlet chamber configured to receive the fluid from the main chamber and to collect a liquid separated from the fluid;

an outlet opening disposed on an exit surface of the outlet chamber, the outlet opening in fluid communication with the outlet chamber; and a plate positioned in the outlet chamber adjacent to the exit surface to form a channel between the plate and the exit surface, the plate protruding over the outlet opening so that the fluid flowing through the outlet chamber and into the outlet opening pulls the liquid collected in the outlet chamber through the channel and out through the outlet opening with the fluid.

34. The system of claim 33, wherein the bottom of the plate is spaced from the bottom of the outlet chamber to form a flow path for the collected liquid to flow to the channel.

35. The system of claim 33, wherein the plate is joined with side surfaces of the outlet chamber to form the channel between the plate and the exit surface.

36. The system of claim 33, wherein the plate further comprises walls extending from the top thereof and joined with the exit surface.

37. The system of claim 33, wherein the plate further comprises walls extending from the bottom to the top thereof and joined with the exit surface to form the channel.

38. The system of claim 33, wherein at least a portion of the fluid undergoes a phase change from liquid to vapor while flowing through the main chamber.

39. The system of claim 38, wherein the fluid includes a refrigerant.

40. The system of claim 39, wherein the liquid collected in the outlet chamber includes the refrigerant.

41. The system of claim 39, wherein the fluid includes an oil.

42. The system of claim 41, wherein the liquid collected in the outlet chamber includes the oil.

43. The system of claim 42, wherein the liquid collected in the outlet chamber includes the refrigerant.

44. The system of claim 33, wherein the plate is a disk having top and bottom portions thereof removed.

45. The system of claim 33, wherein the plate protrudes less than an inch over the outlet opening.

46. The system of claim 33, wherein the plate is positioned less than an inch from exit surface.

47. The system of claim 33, wherein the bottom of the plate is positioned less than an inch from the bottom of the outlet chamber.

* * * * *